US005277522A

United States Patent [19]

Pertz

[11] Patent Number: 5,277,522

[45] Date of Patent: Jan. 11, 1994

[54] TRENCH SHIELD ASSEMBLY

[75] Inventor: Joseph F. Pertz, Hudson, Wis.

[73] Assignee: Empire Manufacturing, Inc., Hudson, Wis.

[21] Appl. No.: 892,187

[22] Filed: Jun. 2, 1992

[51] Int. Cl.[5] ..... E02D 3/02

[52] U.S. Cl. ..... 405/283; 405/272

[58] Field of Search ..... 405/283, 282, 273, 272, 405/277

[56] References Cited

U.S. PATENT DOCUMENTS

| | | | |
|---|---|---|---|
| 4,019,329 | 4/1977 | Griswold . | |
| 4,058,983 | 11/1977 | Griswold | 405/283 |
| 4,193,717 | 3/1980 | Treacy | 405/283 |
| 4,259,028 | 3/1981 | Cook . | |
| 4,659,260 | 4/1987 | Morelli | 405/283 |
| 4,850,747 | 7/1989 | Morelli | 405/283 |
| 4,993,880 | 2/1991 | Collins | 405/282 X |
| 5,096,334 | 3/1992 | Plank | 405/282 X |
| 5,193,928 | 3/1993 | Akesaka | 405/283 X |

OTHER PUBLICATIONS

Griswold Machine and Engineering, Inc. publication Catalog No. 220-A; p. 9.

*Primary Examiner*—Dennis L. Taylor
*Assistant Examiner*—J. Russell McBee
*Attorney, Agent, or Firm*—Burd, Bartz & Gutenkauf

[57] ABSTRACT

A trench shield has a pair of upright shields laterally spaced from each other with spreaders. Each shield has a frame supporting side walls and a horizontal earth penetrating blade. A pounding rail is releasably mounted on a channel top member of the frame. The pounding rail is an inverted channel member located in the channel of the top member. Rods secured to opposite sides of the pounding rail cooperate with the top member to retain the pounding rail on the top member and allow removal of the pounding unit from the top member. Collars secured to opposite ends of the frame accommodate the spreaders.

20 Claims, 2 Drawing Sheets

TRENCH SHIELD ASSEMBLY

FIELD ON INVENTION

The invention is in the field of trench shoring structures used in excavation work. These structures are trench boxes having side walls providing barriers that keep the excavation free from earth, mud and water.

BACKGROUND OF THE INVENTION

Trench boxes having side panels spaced apart with spreaders are used in trenches to hold out earth, mud, water and excavated debris so that work can proceed in the trench. The trench boxes are assembled at the work site. Lifting equipment is used to place the trench boxes into an earth opening. The trench boxes are pounded into the earth to a desired level by applying impact forces on top of the panels. These forces can damage the top members of the panels. Pounding rails having a tubular member filled with wood have been used as top members of the panels to help absorb impact during driving of the panels down to grade. The lower edge of each panel is beveled to facilitate penetration into the earth. An example of a trench panel having a beveled lower edge and a bar is disclosed by J. L. Griswold in U.S. Pat. No. 4,019,329. The trench box is moved along the trench as digging proceeds and the old opening behind the trench box is closed over the pipe or cable placed in the trench. The interior spaces between the side walls accommodate water impermeable low weight plastic foam to preclude the collection of mud and water in the panels. J. B. Cook in U.S. Pat. No. 4,259,028 discloses an example of a trench box panel having a foam plastic filler to prevent intrusion of water, mud and grime into the panel.

SUMMARY OF THE INVENTION

The invention is a strong and relatively light weight trench shield used in a trench shield assembly in excavation work. The shield has a frame comprising vertical and horizontal structural members or bars rigidly connected together. The top member is an elongated channel member having a base and upwardly directed side flanges defining an open top channel. An elongated pounding rail located in the channel can be replaced when it is damaged by impact forces used to pound the shield to grade. The pounding rail comprises an inverted channel member having side walls that extend down into the channel of the top member and engage the base thereof. Rods secured to opposite sides of the inverted channel member and flanges of the top member wedge with a tight fit against the side flanges to retain the pounding rail on the top member. The pounding rail can be separated from the top member without taking the shield apart. A new pounding rail can be placed into the top member after the old pounding rail has been removed.

The frame has a first pair of spaced vertical members at one end and a second pair of spaced vertical members at the other end thereof. Connector collars providing strong connecting structure for the spreaders are located between the pairs of vertical members and project from the inside wall of the shield. Horizontal support members secured to the pairs of vertical members are located on opposite sides of the collars. Rods secured to the collars and vertical and support members connect the collars to the frame and prevent rotation of the collars relative to the frame.

DESCRIPTION OF PREFERRED EMBODIMENT

Figure 1:
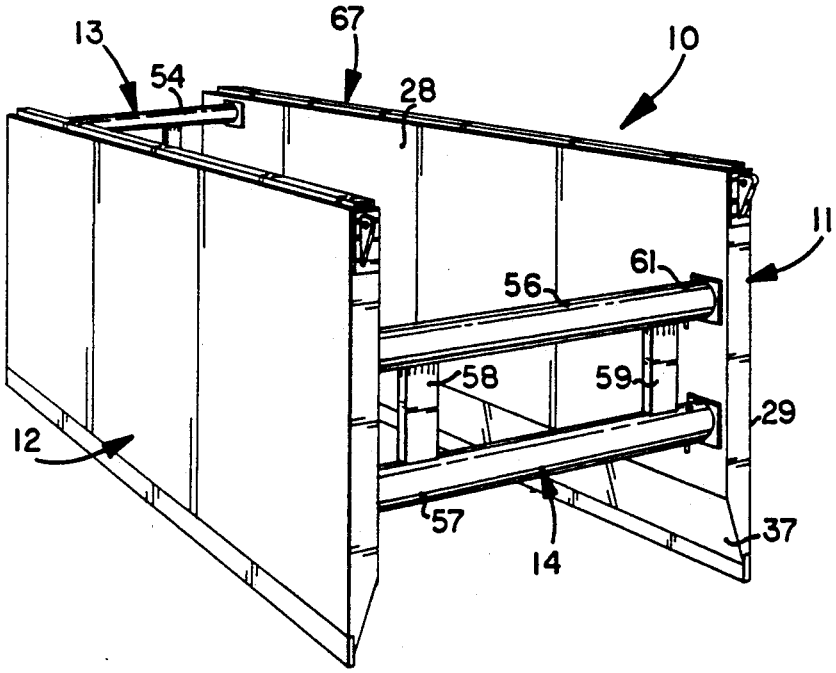
FIG. 1 is a perspective view of the trench shield assembly of the invention.
Figure 2:
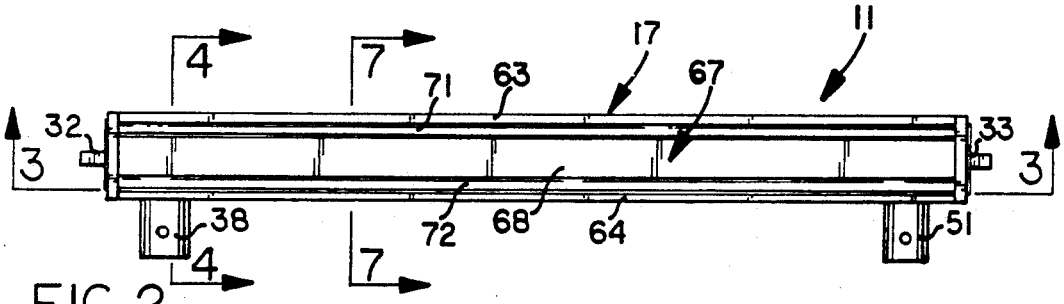
FIG. 2 is an enlarged top plan view of a shield of the trench shield assembly of FIG. 1.

Referring to FIG. 1, there is shown the trench shield assembly of the invention indicated generally at 10 used in trenches, ditches and earth openings to shore the earth and prevent the collapse of the earth into the trenches and hold mud, water, and debris out of the trenches. Trench shield assembly 10 has a pair of upright generally flat shields or panels 11 and 12 laterally spaced from each other with spreaders 13 and 14. The spreaders 13 and 14 are releasably connected to panels 11 and 12 to allow erection of shield assembly at the work site.

Figure 3:
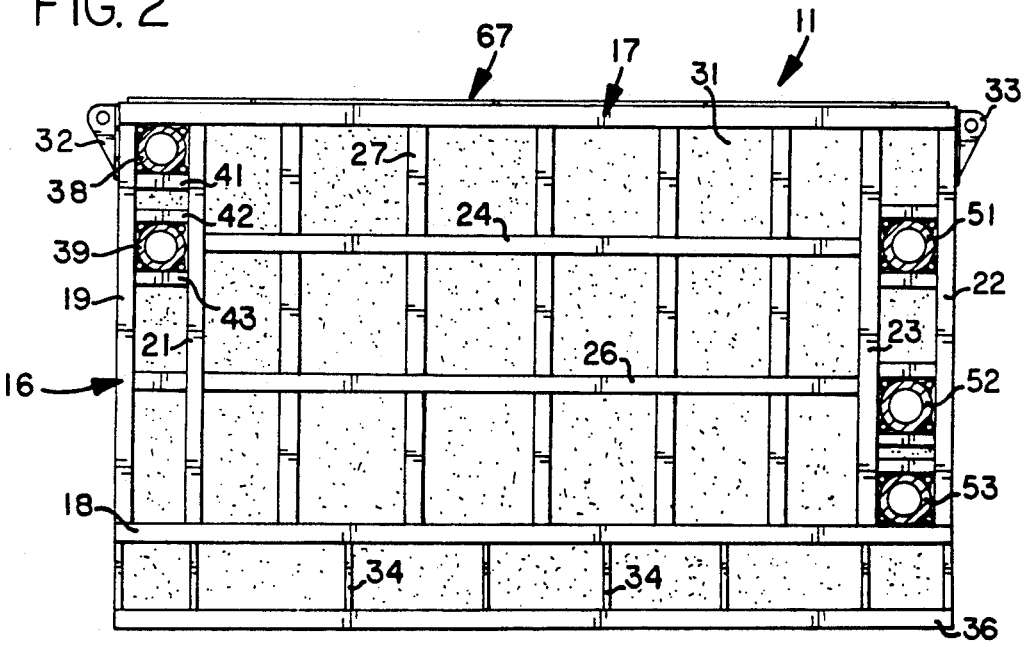
FIG. 3 is a sectional view taken along the line 3—3 of FIG. 2.

As shown in FIG. 3, shield 11 has a framework, indicated generally at 16, comprising a longitudinal top member 17 and a longitudinal bottom member 18. A pair of upright end members 19 and 21 are connected to the left end of the top and bottom members 17 and 18. In a similar manner a pair of upright end members 22 and 23 are connected to the right ends of the top and bottom members 17 and 18. The midsection of the framework has a pair of horizontal cross members 24 and 26 that are secured at their opposite ends to the upright end members 21 and 23. A plurality of upright members 27 are secured to the top and bottom members 17 and 18 and cross members 24 and 26 as seen in FIG. 3. The entire framework is a one-piece welded structure that provides support for an inside wall or skin 28 and an outside wall or skin 29. Walls 28 and 29 are secured to the framework to provide generally flat smooth surfaces that allow the shield to be placed in the soil and removed therefrom.

The internal spaces of framework 16 are filled with a core or foam filler 31 to minimize water, mud, and sand build-up within the shield. The foam filler can be a light weight fire retardent expanded polystyrene. The filler 31 is impermeable to water and can be a rigid or semi-rigid form. Other types of foam plastic can be used to accommodate the spaces within framework 16.

As seen in FIG. 3, ears 32 and 33 are secured to the upper ends of upright members 19 and 22. The ears have holes to accommodate structures used to pull trench shield 11 from the soil. Ears 32 and 33 are also used to connect additional shields to the top of shield assembly 10 for use with deep trenches.

Figure 4:
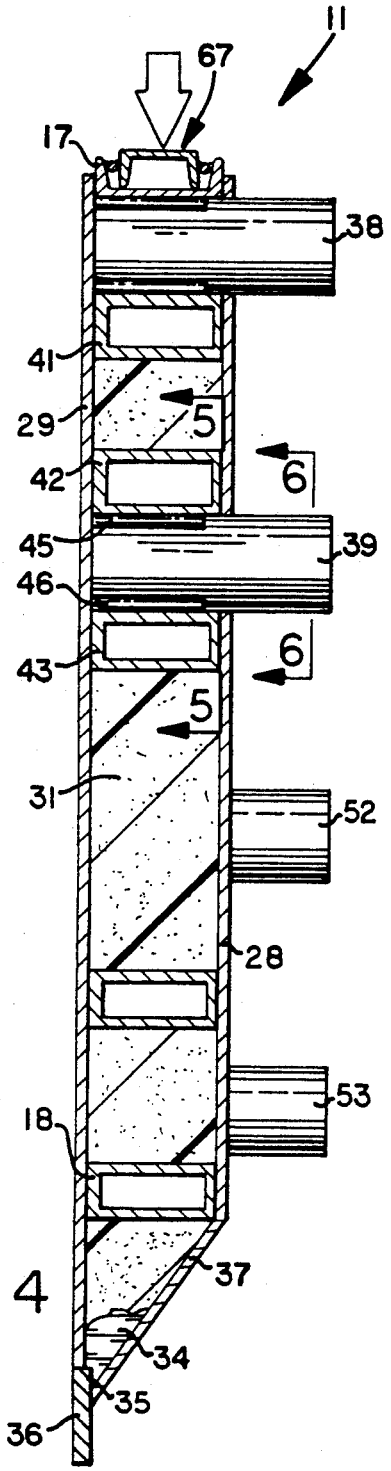
FIG. 4 is an enlarged sectional view taken along the line 4—4 of FIG. 2.

As seen in FIGS. 3 and 4, a plurality of generally triangular gussets 34 are secured to the lower side of the bottom member 18. The lower edge of each of the gussets is secured to a generally horizontal blade 36 that provides a knife-like edge that allows pushing of the shield into the soil. The lower portion of the gussets 34 have notches 35 that accommodate the upper portions of blade 36 to anchor blade 36 on gussets 34 to reduce stress and forces on side wall 29. Blade 36 is welded to each of the gussets. The inclined portions of the gussets 34 are is secured to an upwardly directed plate 37 that extends from blade 36 to the inside wall 28, as seen in FIG. 4. The spaces between adjacent gussets 34 is filled with foam plastic material.

A pair of connector collars 38 and 39 are secured to the upper portion of shield 11 to provide supports for spreader 13. Each collar 38 and 39 is a cylindrical metal tube extended about 8 inches inwardly from wall 28. Collar 38 is located between top member 17 and a support member 41 extended between and secured to upright members 19 and 21. Collar 38 projects inwardly through a suitable hole in inside wall 28. Collar 39 is located between support members 42 and 43 that are secured to upright members 19 and 21. Collar 38 extends through a suitable hole in the inside wall 28 and has an external portion for accommodating the tubular end of spreader 13.

Figure 5:
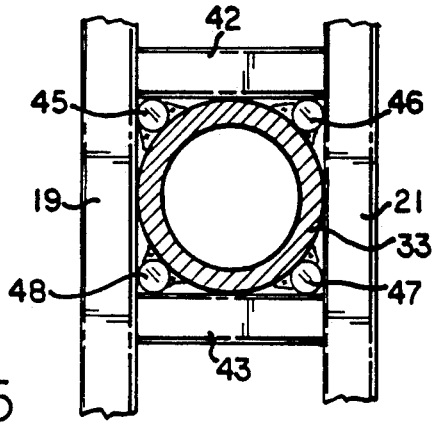
FIG. 5 is an enlarged sectional view taken along the line 5—5 of FIG. 4.

As shown in FIG. 5, collar 33 has top and bottom surfaces that engage support members 42 and 43 and opposite side surfaces that engage upright members 19 and 21. Elongated rods or cylindrical members 45, 46, 47 and 48 are located in the corners formed by the members 19, 42, 21 and 43 and engage separate portions of the collar 33. Rods 45–48 are welded to collar 33 and the frame members 19, 42, 21 and 43. Rods 45–48 prevent collar 33 from rotating relative to framework 16 and provide additional support for collar 33 on framework 16.

Figure 6:
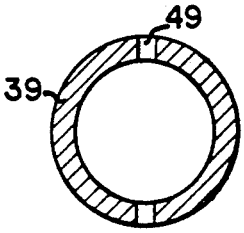
FIG. 6 is an enlarged sectional view taken along the line 6—6 of FIG. 4.

As shown in FIG. 6, collar 39 has vertical hole 49 to accommodate pins, such as pin 61, to connect the spreader to collar 39. The opposite ends of spreaders 13 and 14 are pinned to the adjacent collars. The spreaders have tubular members that telescope over the collars and accommodate pins to releasably connect the spreaders to the collars.

Returning to FIG. 3, the right end of shield 11 has connector collars 51, 52 and 53 secured to upright members 22 and 23. Collars 51–53 are connected to upright members 22 and 23 in the same manner as shown in FIG. 5.

As shown in FIG. 1, spreader 13 has a transverse tubular member 54 and a lower tubular member (not shown) that are releasably connected to the collars on shields 11 and 12. Spreader 14 has a pair of horizontal tubular members 56 and 57 having ends that telescope over the collars and releasably connect it thereto with pins 61. A pair of upright members 58 and 59 are secured to tubular members 56 and 57.

Figure 7:
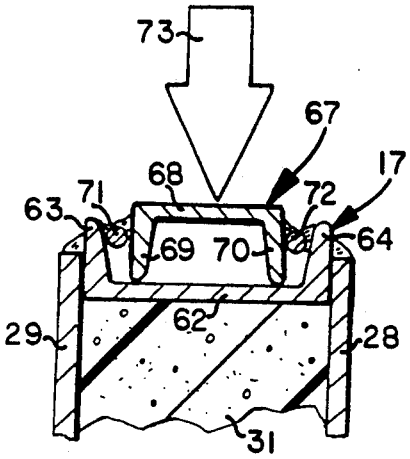
FIG. 7 is an enlarged sectional view taken along the line 7—7 of FIG. 2.

Refering to FIG. 7, top member 17 is a channel member having a generally flat horizontal base 62 joined to upright sides or flanges 63 and 64 to form a channel 66. Member 17 extends along the entire length of shield 11. A pounding rail, indicated generally at 67, is located within channel 66. Pounding rail comprises an inverted U-shaped channel member having a base 68 and downwardly directed flanges or sides 69 and 70. The sides 69 and 70 of rail 67 have a vertical height greater than the vertical height of flanges 63 and 64 to locate base 68 above the top edges of flanges 63 and 64. This ensures that the pounding forces, indicated by arrow 73, are directed to pounding rail 67 without hitting flanges 63 and 64.

Pounding rail 67 is releasably retained on top member 17 with rods 71 and 72 secured by welds to the mid-sections of the outside walls of flanges 69 and 70 and inside walls of flanges 63 and 64. Rods 71 and 72 engage with wedge or tight fits the inside walls of flanges 63 and 64 to releasably retain or hold pounding rail 67 on top member 17. Flanges 69 and 70 are longer than flanges 63 and 64 to locate the base 68 above the top edges of the flanges 63 and 64 of top member 17. Pounding rail 67 absorbs impact when driving shield 11 down to grade. Force indicated by arrow 73 is applied to the pounding rail 67 to force blade 36 into the earth and thereby position shield 11 in the trench according to the requirements of the construction job.

In use, shields 11 and 12 are connected with spreaders 13 and 14. Opposite ends of spreaders 13 and 14 are pined to collars 38, 39 and 51, 52. Shield assembly 10 is then placed in a trech or excavation in the earth with an equipment handling machine. Force is applied to pounding rails 67 to drive blades 36 into the earth to position shield assembly 10 to a level required by the construction job.

While there is shown and described an embodiment of the trench shield assembly, it is understood that changes in size, materials, and arrangement of structure can be made by one skilled in the art without departing from the invention. The invention is defined by the following claims.

I claim:

1. A trench shield comprising: a frame having vertical and horizontal members including a horizontal top member and a horizontal bottom member, side walls secured to opposite sides of the frame to enclose the spaces between adjacent members, said top member comprising an elongated channel member having a base, upright side flanges, and a channel between said side flanges, a pounding rail located in said channel in engagement with the base, said pounding rail having a height greater than the height of the side flanges, and rod means along at least one side thereof engagable with a flange to retain the pounding rail on the top member and allow removal from the top member.

2. The trench shield of claim 1 wherein: said pounding rail is an elongated pounding member having opposite sides, said rod means comprising elongated rods secured to the opposite sides of the elongated pounding member, said rods being engagable with a tight fit with the adjacent flanges to hold the pounding rail on the top member and allow removal of the pounding rail from the top member.

3. The trench shield of claim 2 wherein: said pounding member is an inverted channel member having a horizontal base and side walls, said side walls extended into the channel of the top member and engagable with the base thereof, said elongated rods comprising a first rod secured one side wall and a second rod secured to the other side wall, said first and second rods located in tight fit engagement with said side flanges of the top member to retain the pounding member on the top member and allow removal of the pounding member from the top member.

4. The trench shield of claim 3 wherein: the first and second rods each have a length about the same as the length of the pounding member.

5. The trench shield of claim 1 including: foam plastic material located in the spaces between adjacent members and the side walls.

6. The trench shield of claim 1 including: gusset members secured to the bottom member and extended downwardly therefrom, each gusset member having a vertical edge and a downwardly and outwardly inclined edge, an elongated vertical blade secured to the gusset members for penetrating the earth below the shield, one of said side walls being secured to said vertical edges of the gusset members, and a plate secured to the inclined edges of the gusset members, said plate extending from the blade to the outher of said side walls thereby enclosing the spaces between adjacent gusset members.

7. The trench shield of claim 6 including: foam plastic material located in the spaces between adjacent members including adjacent gusset members and the side walls and plate.

8. The trench shield of claim 1 wherein: the frame has a first pair of spaced vertical members at one end of the frame and a second pair of spaced vertical members at the other end of the frame, connector collars located between the pairs of vertical members and projected outwardly from a side wall, generally horizontal support members secured to the pairs of vertical members on opposite sides of the collars and rod means secured to the collars and vertical and support members to secure the collars to the frame.

9. The trench shield of claim 8 wherein: the rod means comprise cylindrical rods located in the acreas adjacent the connection of the vertical members and support members.

10. The trench shield of claim 8 wherein: the collars are cylindrical tubes, said tubes having outer surfaces located in engagement with the vertical members and support members, and said rod means comprise cylindrical rods secured to the tubes, and at least one of support and vertical members.

11. A trench shield comprising: a frame having vertical and horizontal members including a horizontal top member and a horizontal bottom member, said vertical members including a first pair of spaced vertical members at one end of the frame and a second pair of spaced vertical members at the other end of the frame, side walls secured to opposite sides of the frame to enclose the spaces between adjacent members, connector collars located between the pairs of vertical members and projected outwardly from a side wall, generally horizontal support members secured to the pairs of the vertical members on opposite sides of the collars and rod means secured to the collars and vertical and support members to secure the collars to the frame.

12. The trench shield of claim 11 wherein: the rod means comprise cylindrical rods located in the areas adjacent the connection of the vertical members and support members.

13. The trench shield of claim 11 wherein: the collars are cylindrical tubes, said tubes having outer surfaces located in engagement with the vertical members and support members, and said rod means comprise cylindrical rods secured to the tubes and at least one of the support and vertical members.

14. The trench shield of claim 11 including: a pounding means mounted on the top member.

15. The trench shield of claim 11 wherein: said top member comprises an elongated channel member having a base, upright side flanges, and a channel between said side flanges, a pounding rail located in said channel in engagement with the base, said pounding rail having a height greater than the height of the side flanges, and rod means attached to the pounding rail engagable with a flange to retain the pounding rail on the top member and removal of the pounding rail from the top member.

16. The trench shield of claim 15 wherein: said pounding rail is an elongated pounding member having opposite sides, said rod means comprising elongated rods secured to the opposite sides of the elongated pounding member, said rods being engagable with a tight fit with the adjacent flanges to hold the pounding rail on the top member and allow removal of the pounding rail from the top member.

17. The trench shield of claim 16 wherein: said pounding member is an inverted channel member having a horizontal base and side walls, said side walls extended into the channel of the top member and engagable with the base thereof, said elongated rods comprising a first rod secured to one side wall and a second rod secured to the other side wall, said first and second rods located in tight fit engagement with said side flanges of the top member to retain the pounding member on the top member and allow removal of the pounding member from the top member.

18. The trench shield of claim 11 including: foam plastic material located in the spaces between adjacent members and the side walls.

19. The trench shield of claim 11 including: gusset members secured to the bottom members and extended downwardly therefrom, each gusset member having a vertical edge and a downwardly and outwardly inclined edge, an elongated vertical blade secured to the gusset members for penetrating the earth below the shield, one of said side walls being secured to said vertical edges of the gusset members and a plate secured to the inclined edges of the gusset members, said plate extending from the blade to the other of said side walls thereby enclosing the spaces between adjacent gusset members.

20. The trench shield of claim 19 including: foam plastic material located in the spaces between adjacent members including adjacent gusset members and the side walls and plate.

* * * * *